US005826855A

United States Patent [19]

Dick

[11] Patent Number: 5,826,855

[45] Date of Patent: Oct. 27, 1998

[54] PLUG FOR SWIMMING POOL

[75] Inventor: Larry C. Dick, Kent, Ohio

[73] Assignee: The Little Tikes Company, Hudson, Ohio

[21] Appl. No.: 643,582

[22] Filed: May 6, 1996

[51] Int. Cl.[6] ..... F16K 51/00; E04H 4/00

[52] U.S. Cl. ..... 251/144; 137/315; 4/496; 4/507

[58] Field of Search ..... 137/15, 315; 251/144; 4/496, 507

[56] References Cited

U.S. PATENT DOCUMENTS

| | | | |
|---|---|---|---|
| D. 351,220 | 10/1994 | Barnes | D23/260 |
| 1,127,483 | 2/1915 | Meinecke . | |
| 1,737,981 | 12/1929 | Smith . | |
| 2,571,144 | 10/1951 | Lobl | 150/8 |
| 2,616,095 | 11/1952 | Hasselquist | 4/177 |
| 2,718,014 | 9/1955 | Mizrach et al. | 4/177 |
| 2,838,768 | 6/1958 | Fischett | 4/177 |
| 3,239,149 | 3/1966 | Lindberg, Jr. | 239/203 |
| 4,449,692 | 5/1984 | Rhodes | 251/144 |
| 4,934,654 | 6/1990 | Linnemann | 251/144 |
| 5,016,296 | 5/1991 | Beaumont | 4/507 |
| 5,341,523 | 8/1994 | Barnes | 4/507 |
| 5,722,451 | 3/1998 | Godeau et al. | 137/315 |

OTHER PUBLICATIONS

P. 4, Plug for swimming pool; The Little Tikes Company, 2180 Barlow Road, Hudson, Ohio 44691. Publication date 1985.

P. 105, Plug for swimming pool; The Little Tikes Company, 2180 Barlow Road, Hudson, Ohio 44691. Publication date 1996.

*Primary Examiner*—A. Michael Chambers

*Attorney, Agent, or Firm*—Richard B. O'Planick

[57] ABSTRACT

A pool plug (10) is disclosed comprising a plunger member (12) and a base member (14). The base member (14) is cylindrical having an axial passageway (30) therethrough and opposed annular skirt flanges (32,36) projecting toward each other from opposite rims (26,28) of the member (14). The flange (32) collapses diametrically to allow the base member (14) to be inserted into a panel aperture, and skirt flange (36) depresses to a point that the lower flange (32) is free to open up and resume its original form, capturing the panel between the flanges (32,36). Composed of elastomeric plastic, the flanges (32,36) flex to allow use of the plug in pool panels having a thickness variable within a specified range. The plunger member (12) reciprocally moves upward and downward within the passageway (20) and includes ports (54) that open and close in response thereto. An inwardly directed annular sealing flange (40) engages the plunger member (12) to seal the plunger when it is pushed downward into a closed position.

20 Claims, 5 Drawing Sheets

PLUG FOR SWIMMING POOL

BACKGROUND OF THE INVENTION

1. Field of the Invention

The subject invention relates generally to plugs for liquid reservoirs and, more specifically, to plugs for portable swimming pools.

2. The Prior Art

Portable swimming pools for backyard use are common consumer items. Typically such pools are formed from plastic material. The wall thicknesses of commercially available pools vary within a prescribed range, depending on the wall strength necessary for the volume of water that a particular pool is designed to contain. The pools also have a drain incorporated into a bottom panel whereby water can be drained from the pool if desired. The drains of conventional pools incorporate many different types of plug mechanisms, ranging from simple detachable stoppers that are inexpensive to manufacture but prone to becoming lost, to permanently attached but more expensive plug assemblies that assemble to an aperture formed in the bottom panel of the pool.

While conventional plug assemblies work well and have been well accepted, certain deficiencies attendant their method of assembly to pools and their cost have made their use less than optimal. Because conventional plastic pools are large and bulky, it is desirable that the plugs attach to the drain holes from one direction and not require that the pool be inverted or otherwise handled during the assembled procedure. Moreover, it is important that such plugs be inexpensive to produce and that they assemble to the pool with minimal labor in order to minimize cost. Since portable pools are relatively inexpensive items, a plug that is either costly to manufacture or to assemble will have a negative impact on the commercial viability of the product.

Available plug base members, however, often require that associate plug hardware be attached from both sides of the drain panel, making assembly cumbersome and labor intensive and, hence, costly. In addition, known plugs that function satisfactorily are often of multipiece construction, and require assembly hardware. This also adds to their cost and make them less than an optimal solution to the industry's needs. Finally, because manufacturers typically produce a line of pools, each having a different wall thickness depending on its design, it is desirable that the same plug be flexible enough to function in all pools in the line, regardless of wall stock thickness. Conventional plugs are typically not able to accommodate a variety of wall thicknesses or, if so, often require complex and expensive adjustment mechanisms to provide such flexibility.

SUMMARY OF THE INVENTION

The subject invention overcomes the aforementioned deficiencies by providing a plug of two-piece, inexpensive plastic molded construction that is operationally flexible enough to function in pools having a panel thickness variable within limits. In addition, the plug is easy and inexpensive to assembly requiring neither assembly hardware or tools and functions to provide a leak proof seal that released by the user.

The plug comprises a cylindrical molded base member of elastomeric flexible material that is formed to provide first and second flared skirts directed toward each other from opposite end rims of the base member. The base member includes an axial passageway extending between cylindrical sidewalls and is dimensioned to closely insert into and to be retained within a sized pool panel aperture. The first flared skirt diametrically collapses when inserted through the pool aperture and thereafter expands back into its original configuration to abut an opposite surface of the panel to prevent retraction of the base member from the aperture.

The second skirt engages the inward side of the pool panel along a terminal lower edge and depresses downward to allow the first skirt to clear the panel and resume its original configuration. Because the skirts are elastomeric, the base member can attach through panels having a range of thicknesses, making the plug versatile and flexible in use. Moreover, insertion of the plug base occurs from one side of the pool and can be done manually or by automation, without assembly hardware or tools.

A plunger member is captured within the passageway of the base member, and comprises cylindrical sidewalls and an axial through bore. The plunger reciprocally moves between an extended position partially removed from the passageway and a retracted position substantially confined within the passageway. Portals extend through the plunger member sidewalls and allow an influx of water therethrough when the plunger is extended and close off within the base member passageway with the plunger retracted. A sealing flange extends inward from the base member sidewalls and engages the plunger member sidewalls to prevent water from entering into the base member passageway around the plunger.

Accordingly, it is an objective of the invention to provide a plug that comprises a minimum number of inexpensively produced components.

A further objective is to provide a flexible drain plug that can functionally accommodate wall thicknesses variable within a prescribed range.

Yet a further objective is to provide a drain plug that can be assembled from one direction, and which requires no hardware or tools for assembly.

Still a further objective is to provide a drain plug that is relatively leakproof and is easily moved between an open and a closed condition by the user.

Another objective is to provide a drain plug that is economically and readily manufactured and easily installed and used.

These and other objectives, which will be apparent to those skilled in the arts, are achieved by a preferred embodiment that is described in detail below and illustrated in the accompanying drawings.

DESCRIPTION OF THE PREFERRED EMBODIMENT

Figure 1:
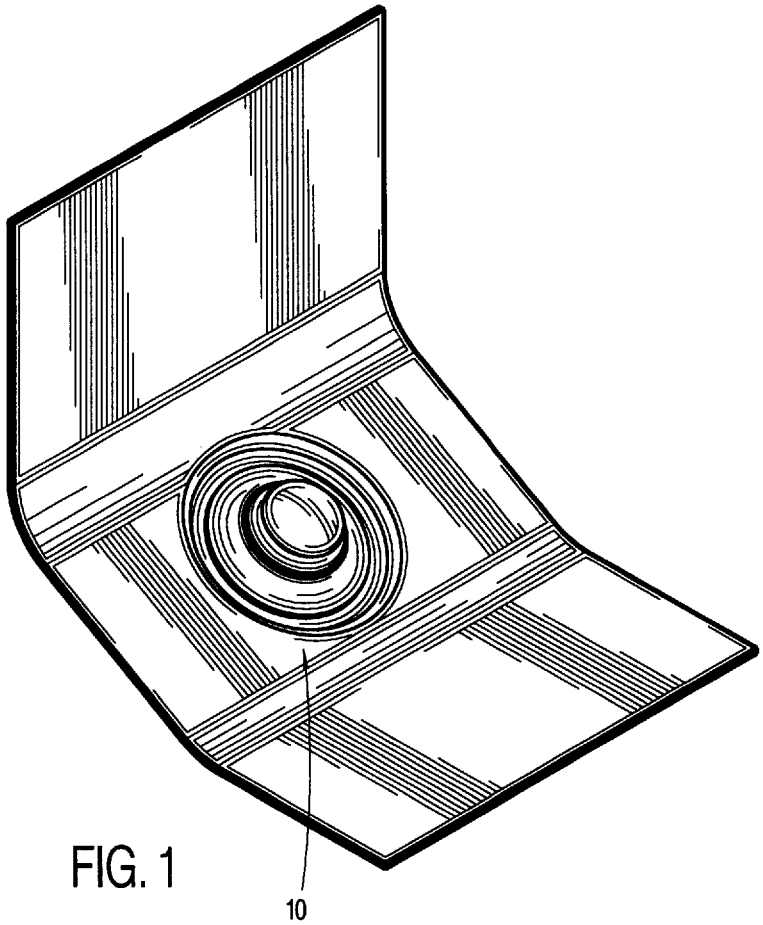
FIG. 1 is an assembled perspective view of the drain plug within a pool panel fragment.
Figure 2:
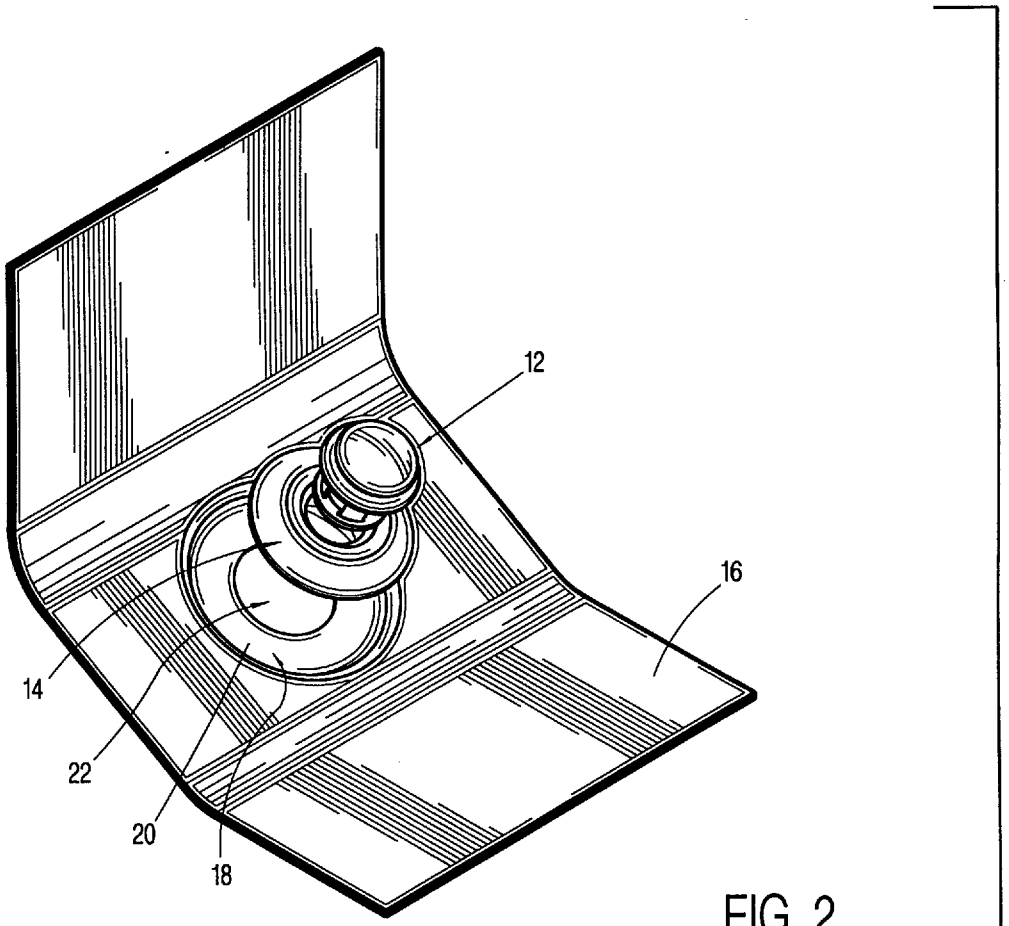
FIG. 2 is an exploded perspective view thereof.
Figure 3:
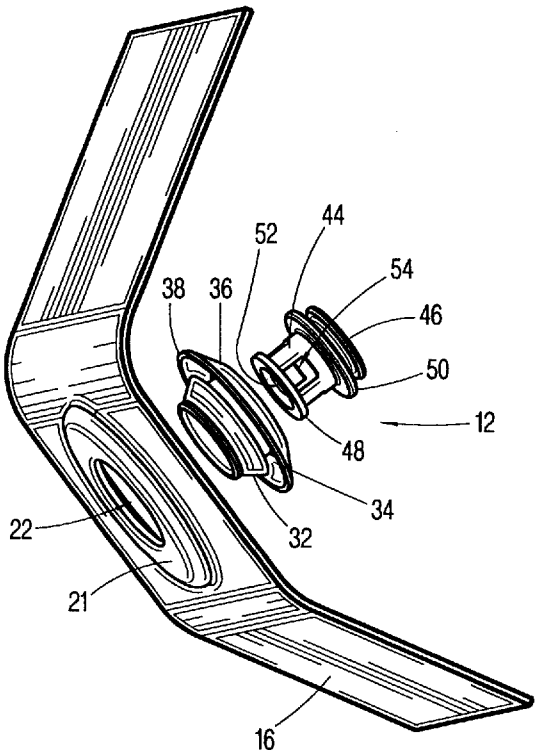
FIG. 3 is an exploded perspective view thereof from an underside.
Figure 4:
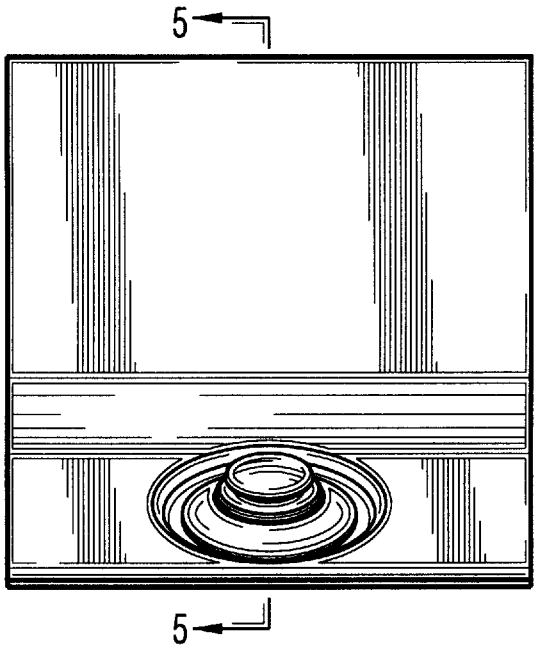
FIG. 4 is an assembled perspective view thereof with the plug in the closed position.

Referring to FIGS. 1–5, the subject drain plug 10 consists of two molded plastic components 12,14. The plunger member 12 and base member 14 are molded by conventional methods such as injection molding from conventional plastic such as high density polyethylene. The plug 10 is preferably intended to be used in conjunction with a plastic swimming pool, a portion of a lower panel 16 being depicted in the drawings; however, the use of the subject invention is not intended to be so restricted. The invention is useful in any application where a drain plug is necessary or desirable.

The panel 16 is formed to define a well or depression 18 terminating at an inward floor surface 20. An underside surface 21 is opposite to surface 20, preferably located at a corner of the pool as shown. A central aperture 22 extends through the panel floor 20 to the underside surface 21.

The base member 14 is generally configured as a cylinder, having cylindrical sidewalls 24 which extend between a lower rim 26 and an upper rim 28. An axial passageway 30 extends along the axis of the member 14 from the rim 26 to the rim 28. A first flared, outwardly beveled annular skirt 32 extends from the rim 26 toward the opposite end of the base member. The skirt 32 terminates at a remote edge 34. The skirt 32 extends at a fifty-four degree angle to the horizontal and terminates approximately midlength of the member 14.

A second annular skirt 36 flares outwardly and away from the upper rim 28 at a thirty-two degree angle, terminating at a lower edge 38. The spacing between the edges 34,38 of the skirts 32,36 is approximately 0.060 of an inch. The skirts 32,36 are integrally formed projections from the sidewalls 24, and each exhibits resilient flexibility attributable to an elastomeric composition.

Extending inwardly and downwardly from the upper rim 28 into the passageway 30 is an annular sealing flange 40 that terminates at a downturned edge portion 42. The sealing flange 40 is canted downwardly at a fifty degree angle. The sealing flange 40 thus constitutes a third skirt extending from the sidewalls 24; the other two being skirts 32,36.

The plunger member 12 is likewise generally of cylindrical configuration defined by sidewalls 44. A circular endcap 46 is provided at one end of the member 12 and edges of the end cap 46 overhand the sidewalls 44. At the opposite end of the member 12, projecting outward from the sidewalls 44 is an annular stop flange 48. An outwardly projecting sealing flange 50 extends annular about the sidewalls 44, spaced a distance from the end cap 46. An axial bore 52 projects through the member 12 from one end to the end cap 46. Positioned through the sidewalls in communication with the bore 52 are a series of four ports 54 located between the sealing flange 50 and the stop flange 48.

It will be appreciated that the plunger member 12 is captured within the passageway 30 of the base member 12. The downward cant of the sealing flange 50 allows the plunger member 12 to pass in the downward direction into the passageway 30. Inside the passageway 30, the plunger member stop flange 48 at the bottom catches the sealing flange 50 of the base member 14 to prevent the plunger member 12 from pulling out.

Figure 5:
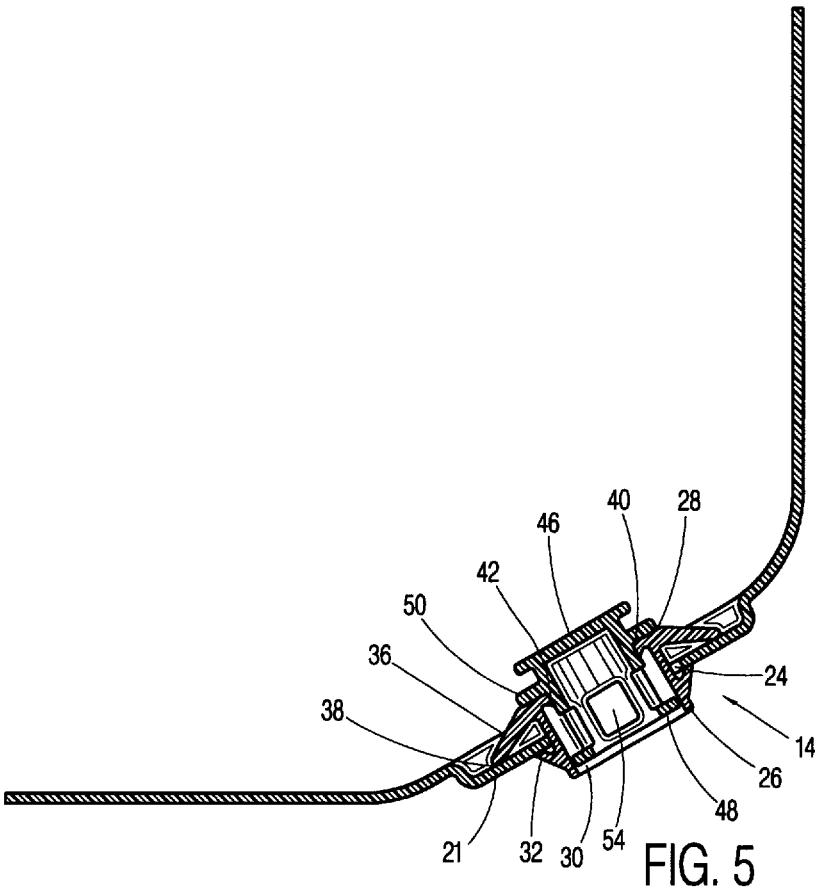
FIG. 5 is a transverse section view thereof taken along the line 5—5 of FIG. 4.

So located, the plunger member 12 is reciprocally moveable between an extended (open) upward position, partially removed from the passageway 30, and a retracted (closed) position depicted in FIG. 5. In the open, up position, the ports 54 are exposed to the reservoir and water can drain therethrough, into the base member passageway 30, and thence out of the bottom of the pool. In the down, or closed position, the ports 54 are within the passageway 30 and are not open to admit water. The sealing flange 40 of the base member engages the cylindrical sidewalls 44 of the plunger member and prevents water from penetrating into the axial passageway 30, around the sidewalls 44. In addition, in the down position, the sealing flange 50 of the plunger member 12 seals against the upper rim 28 of the base member under water pressure, and prevents any water form entering passageway 30.

Insertion of the plug member 12 into the passageway 30 can be effected by hand, without handtools, or by automation if so desired. Once captured, the plunger member 12 can move up and down in reciprocal fashion but cannot pull out of the base member 14.

Assembly of the base member 14 into the panel aperture 22 is likewise effected by simple downward insertion from one direction, either by hand or by automated equipment. The base member is inserted downward into the aperture 22, and is sized such that the skirt 32 engages the edges of the aperture 22 and is deformed thereby into a smaller diameter configuration. The skirt 32 collapses as it is inserted into the aperture 22. The upper skit edge 38 engages the panel floor surface 20 and the upper flange 38 is depressed downward to a point that the lower flange 32 is free to open up into its original diameter and configuration. The panel wall is thereby trapped between the skirt flange edges 34,38 and the base member 14 is securely seated within the aperture 22.

It will be appreciated that the upper flange 38 is flexible and seals against the floor surface 20 under water pressure, to prevent leakage around the base member 14. The lip seal created by the flange 40 of the base member prevents leakage into the passageway 30, around the plunger.

Because the skirts 32,36 are resilient and flexible, the subject base member 14 is flexible and can be assembled to pool panels having a thickness variable within limits. The range of variation is generally 0.060 to 0.187 inches. Thus, one plug can be used on a line of pool products, each having a differing wall stock thickness within the aforementioned design range.

Insertion of the base member 14 into the pool aperture 22 is from one direction and is accomplished without tools or assembly hardware. Moreover, no manipulation of the pool is necessary and labor cost is minimized. Since the plug is comprised of only two components, each of which being economical to produce from standard plastics material by conventional means, the cost of manufacture for the plug is likewise low, giving the subject invention substantial commercial advantage over state of the art plugs.

It will further be appreciated that use of the plug is easily accomplished. The plunger head flange 46 can be grasped and the plunger member 12 pulled upward, exposing the ports 54 to drain water. Just as easily the plunger member 12 can be pushed downward, closing off the ports 54.

While the preferred embodiment of the subject invention is described above, the invention is not intended to be so limited. Other embodiments which will be apparent to those skilled in the art and which utilize the teachings herein set forth, are intended to be within the scope and spirit of the subject invention.

What is claimed is:

1. A plug that inserts into and is retained within a reservoir panel aperture, comprising:

a cylindrical plug base member having sidewalls extending from a first member end to a second member end and an axial passageway extending through the member from the first end to the second end, the member having a diameter dimensioned for close receipt within the aperture, and the member having a first flared skirt of elastomeric flexible material composition that extends outward from the first end toward the second end and diametrically collapses from an expanded configuration to allow insertion of the first end of the plug base member through the panel aperture, and the first skirt opens thereafter into the expanded configuration and has a terminal edge that abuts against an opposite surface of the panel to prevent retraction of the plug base member from the aperture; and a second flared skirt of elastomeric flexible material composition that extends outwardly from the second end toward the first end and comprises a terminal edge that abuts against a proximate surface of the panel to prevent passage of the plug base member through the aperture; and a cylindrical plunger member closely receivable within an inward end of the passageway and reciprocally moving therein between a relatively extended position partially removed from the base member passageway and a relatively retracted position, the plunger member having at least one portal that admits liquid from the reservoir into the plug base member passageway in the extended position and that closes to prevent reservoir liquid from entering the plug base member passageway in the retracted position.

2. A plug according to claim 1, wherein the terminal edges of the upper and lower flared skirts capture the reservoir panel therebetween.

3. A plug according to claim 2, wherein upon insertion of the lower flared skirt of the base member through the panel aperture the upper flared skirt depresses against the panel inward surface a distance sufficient to enable the lower flared skirt to clear the panel and diametrically expand into the relaxed condition.

4. A plug according to claim 3, wherein the upper and lower flared skirts flex to accommodate the mounting of the plug base member in panels having a width variable within prescribed limits.

5. A plug according to claim 4, wherein the plug base member further comprising a sealing flange projecting from the base member sidewalls into the passageway and engaging the plunger member, whereby sealing an inward end of the passageway against liquid entry.

6. A plug according to claim 5, wherein the plunger member comprising an outwardly directed stop flange at an outer end positioned to engage the base member sealing flange when the plunger member reaches the extended position.

7. A plug according to claim 6, wherein the base member sealing flange engages against a circumferential sidewall of the plunger member and the plunger member portal extends through the plunger sidewall adjacent to the stop flange.

8. A plug according to claim 7, wherein the plunger member further comprises an axial bore extending between the sidewall from a first end to a second end of the plunger member, and a cap wall portion for closing the axial bore at the second end.

9. A plug base socket that inserts into and is retained within a reservoir panel aperture comprising:

a cylindrical body having sidewalls extending from a first end to a second end and an axial passageway extending through the body from the first end to the second end, the body having a diameter dimensioned for close receipt within the aperture, and the body having a first flared skirt of elastomeric flexible material composition that extends from the first rim toward the second rim and diametrically collapses from an expanded configuration to allow insertion of the first end of the plug base socket through the panel aperture, and the first skirt opens thereafter into the expanded configuration and has a terminal edge that abuts against an opposite surface of the panel to prevent retraction of the plug base socket from the aperture; and a second flared skirt of elastomeric flexible material composition that extends from the second rim toward the first rim and comprises a terminal edge that abuts against a proximate surface of the panel to prevent passage of the plug base member through the aperture; and the second flared skirt depresses against the panel proximate surface a distance sufficient to enable the first flared skirt to clear the panel and diametrically expand into the expanded configuration.

10. A socket according to claim 9, wherein the terminal edges of the first and second flared skirts capture resiliently pressure the reservoir panel therebetween.

11. A socket according to claim 10, wherein the first and second flared skirts flex to accommodate the mounting of the socket in panels having a width variable within prescribed limits.

12. A socket according to claim 11, wherein the passageway is configured to accept a tubular plunger member that reciprocally moves therein between an extended position partially removed from the passageway and a retracted position within the passageway.

13. A socket according to claim 11, further comprising an inwardly directed sealing flange projecting inwardly from the second end of the sidewalls into the passageway, the sealing flange engaging the plunger member, whereby sealing the passageway second end.

14. A socket according to claim 13, wherein the plunger member has an outwardly directed stop flange at one end positioned to engage the sealing flange when the plunger member reaches the extended position.

15. A plug base socket that inserts into and is retained within a reservoir panel aperture comprising:

a cylindrical body having sidewalls extending from a first rim to a second rim and an axial passageway extending through the body from the first rim to the second rim, the body having a diameter dimensioned for close receipt within the aperture;

first and second outwardly flared skirts of elastomeric flexible material composition projecting from the first and second rims, respectively, toward each other, the skirts each having a terminal free edge, the first skirt edge and the second skirt edge being spaced apart in opposition;

the first skirt diametrically collapses from an expanded configuration to allow insertion of a first end of the plug base socket through the panel aperture, and the first skirt opens thereafter into the expanded configuration wherein the first skirt terminal edge abuts against an opposite surface of the panel to prevent retraction of the plug base socket from the aperture; and the second flared skirt edge abuts against a proximate surface of the panel to prevent passage of the plug base member through the aperture.

16. A plug base socket according to claim 15, wherein the second flared skirt depresses against the panel proximate surface a distance sufficient to enable the first flared skirt to clear the panel and diametrically expand into the expanded configuration.

17. A socket according to claim 16, wherein the first and second flared skirts flex to accommodate the mounting of the socket in panels having a width variable within prescribed limits.

18. A socket according to claim 17, wherein the passageway is configured to accept a cylindrical plunger member that reciprocally moves therein between an extended position partially removed from the passageway and a retracted position within the passageway.

19. A socket according to claim 18, further comprising an inwardly directed sealing flange projecting inwardly from the second end of the sidewalls into the passageway, the sealing flange engaging the plunger member, whereby sealing the passageway second end.

20. A socket according to claim 19, wherein the plunger member has an outwardly directed stop flange at one end positioned to engage the sealing flange when the plunger member reaches the extended position.

* * * * *